United States Patent [19]

Zentner, Jr.

[11] Patent Number: 4,805,916

[45] Date of Patent: Feb. 21, 1989

[54] GAME OF SKILL AND COORDINATION: RING BALL

[76] Inventor: John R. Zentner, Jr., 22442 Bessemer St., Woodland Hills, Calif. 91367

[21] Appl. No.: 96,902

[22] Filed: Sep. 14, 1987

[51] Int. Cl.[4] ..... A63B 67/06

[52] U.S. Cl. ..... 273/336; 273/410; 273/411; 273/425

[58] Field of Search ..... 273/336, 337, 338, 339, 273/317, 359, 386, 410, 411, 424, 425

[56] References Cited

U.S. PATENT DOCUMENTS

| | | | |
|---|---|---|---|
| 1,341,185 | 5/1980 | Lowman | 273/337 X |
| 2,072,682 | 3/1937 | Morgan | 273/412 |
| 3,231,278 | 1/1966 | Boulanger | 273/411 X |
| 4,433,841 | 2/1984 | Kim et al. | 273/338 |

FOREIGN PATENT DOCUMENTS

| | | | |
|---|---|---|---|
| 18999 | of 1899 | United Kingdom | 273/338 |

*Primary Examiner*—William H. Grieb

[57] ABSTRACT

A game of skill, played on a generally level playing surface having a firm base with a yieldable covering. A spherical ball is placed on a court area of the surface, and a series of toroidal rings are thrown, one at a time, from one or several standard throwing distances toward the ball in an attempt to encircle the ball with at least one ring, either by direct landing or by bouncing a ring over and around it, or by causing the ball to roll over and into a previously thrown ring. If the attempt causes a ring to rest directly against a ball or to lean on it, points are also awarded.

13 Claims, 1 Drawing Sheet

GAME OF SKILL AND COORDINATION: RING BALL

This invention relates to a game of skill and coordination, which I call Ring Ball, using a series of rings in combination with a ball. It also relates to a ring retrieving and holding device.

BACKGROUND OF THE INVENTION

The well-known games of horseshoes and quoits employ a stationary target, and the scoring is based on ringers, leaners and adjacency.

Bowling-on-the-green, bocce, and boule employ a plurality of balls, which are usually not true spheres, and scoring is based on adjacency. Players also try to strike an opponent's ball with their own ball in order to drive it away from its position.

The present game has some features like those of horseshoes and quoits and other features like those of boule or bowling-on-the-green, but also adds other features. Like them, it requires skill, and practice can improve one's game. Scoring is somewhat different, but there are features related to the older games.

SUMMARY OF THE INVENTION

The game of the present invention uses one ball and a plurality of rings identical to each other, which have an inner circumference somewhat greater than the diameter of the ball. The ball is placed on or rolled into a prearranged area, usually on a matted playing surface. The players, usually two persons or two groups of persons, alternately throw the rings toward the ball from either a standard distance or a series of standard distances. They attempt to make their ring encircle the ball; if one succeeds, this is termed a "saturn," as it resembles the planet Saturn with its rings. Other scoring arrangements include leaners and adjacency.

If one player achieves a "saturn" by getting his ring to encircle the ball, another player may overcome the scoring effect by, in his turn, throwing a similar saturn, so that his ring overlies that of his opponent; according to the rules of the game, this second saturn by an opponent will nullify an earlier saturn and also score a positive saturn for the one with the overlying ring.

As in boule and bowling-on-the-green, the ball itself is subject to movement, in this case by striking the ball with one of the rings. This may result either in the ball being moved over the edge of and into another ring of the player throwing the ring or in destroying the opponent's leaners or overcoming the opponent's adjacency.

The essential pieces of equipment are, of course, the ball and the rings, both being made to standard sizes, to enable the achievement of a saturn, and being of sufficient weight so that the rings can produce movement of the ball or of other rings, the ball and rings having inherent inertia.

There is preferably also another piece of equipment in the possession of each of the players or each of the teams of players. This is what is called a ring scoop, which preferably is made in two pieces, so that it can be more easily carried and stored, one end comprising a structure used for picking up a ring by inserting that end below one edge of the ring and into the ring, the other end providing a handle with a stop which may be used to retain the rings in an available position during play.

A very important element of the game is the playing surface, which should preferably be somewhat resilient and not a slick surface such as a waxed floor or a tile or concrete surface. The best surface from the standpoint of standardization is a carpet of moderate padding overlying a hard base. This gives good ring hop and good movement of the ball. If there is a wooden floor under the carpet, proper ring hop can be provided without very much padding. The courts for playing the game may be either outdoors or indoors, and another good playing surface is that of grass, preferably well-mown grass, which provides a well-cushioned underpinning. Every grassy area may be a little bit different, but that is satisfactory so long as the surface is not too bumpy or hilly.

One alternate surface is sand, as for example in a beach area where it can be either packed wet sand or, better, dry sand. The rings will not hop on a dry sand surface, but the rest of the game remains the same.

Similarly, ground covered by pine needles or other similar soft material can be used, even though the ground may be hard or even be rock, if the surface is covered sufficiently by pine needles or the like.

Hard abrasive surfaces lead to uncontrolled ball speed and create difficulties even in throwing the ball. Moreover, the abrasive surfaces tend to wear out the equipment.

Other objects and advantages of the invention will appear from the following description of some preferred forms thereof.

IN THE DRAWINGS

FIG. 4 is a view in side elevation of the assembled scoop, looking along the line 4—4 in FIG. 3.

FIG. 5 is a plan view showing five rings that have been thrown and one ball that has been encircled by one of the rings, making a saturn, the other rings being at various distances from the ball.

FIG. 6 is a plan view showing a ball and three rings, one of which touches the ball.

FIG. 7 is a plan view of four rings and a ball, one ring making a saturn, another bearing on the saturn ring and touching the ball.

FIG. 8 is a view in side elevation showing a double saturn and two leaners, or what is called a "logo"; the view also shows a scoop that has picked up a ring.

FIG. 9 is a fragmentary view, partly in section, of a ball and a ring resting on a lawn surface.

FIG. 10 is a fragmentary view, partly in section, of a ball and a ring resting on a sand playing surface.

DESCRIPTION OF SOME PREFERRED EMBODIMENTS OF THE INVENTION

The key parts of the game are (1) the playing surface, (2) the defined playing area or court, (3) the ball, and (4) the rings. There may also be the rings retrieving scoop.

Figure 1:
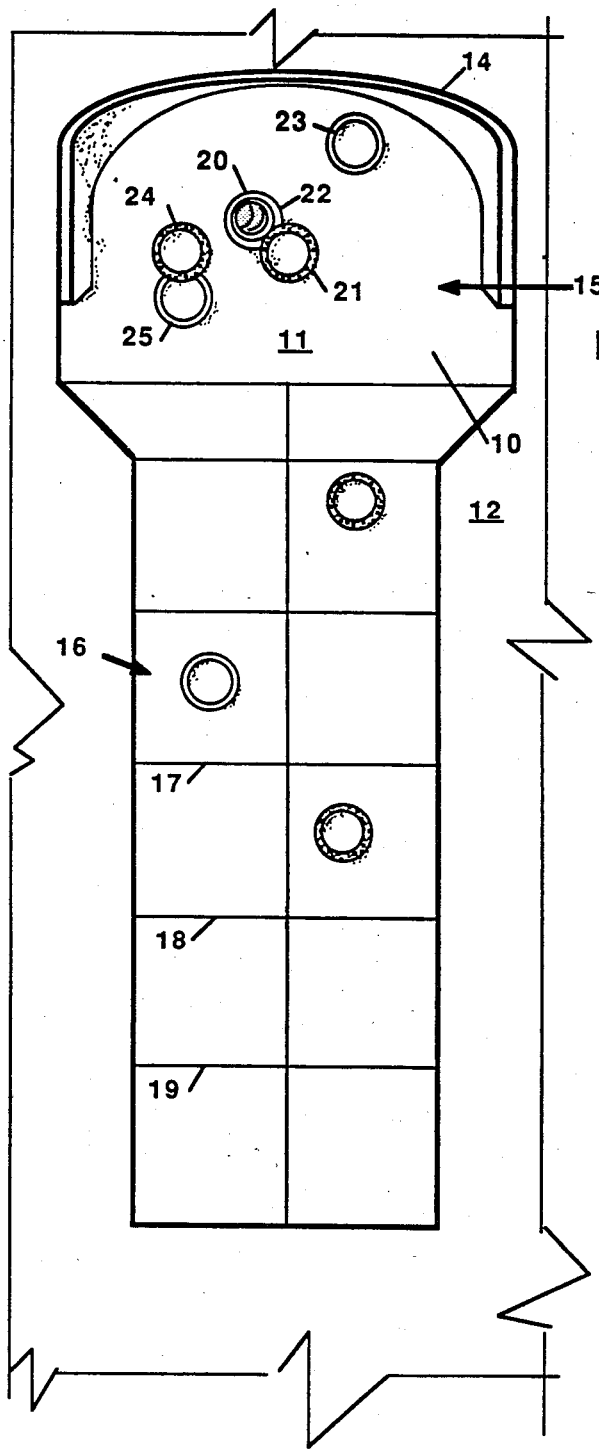
FIG. 1 is a top plan view of a preferred type of playing court, with balls and rings thereon.
Figure 2:
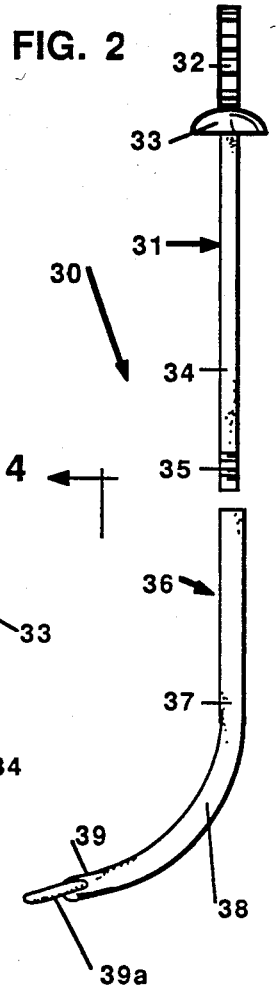
FIG. 2 is a view in side elevation of the two pieces forming a scoop, before assembly.
Figure 3:
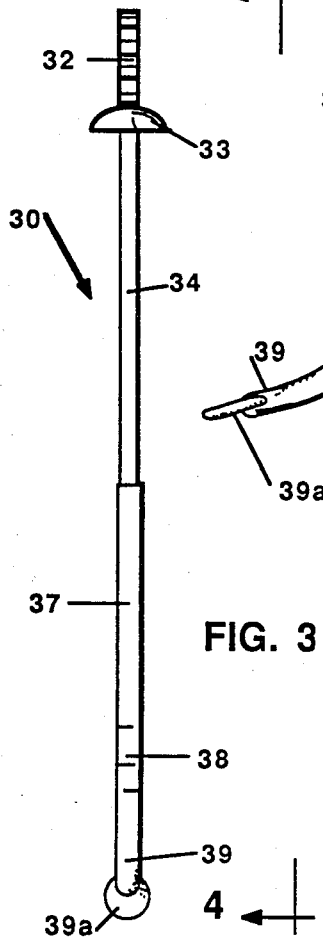
FIG. 3 is a view in front elevation of the scoop.

As stated above, a preferred playing surface 10 (FIG. 1) is a generally planar, somewhat resilient surface with a firm base. Examples, as stated above, are a carpet 11 or other moderate padding over a wooden floor 12. Over a hard floor, such as brick, tile or concrete, the padding 11 would have to be thicker and more springy. A lawn 40 over firm soil 41 (FIG. 9) is quite satisfactory, especially with short grass covering a well-cushioned underpinning of hard dirt. Alternative surfaces include loose, dry sand 42 (FIG. 10) and pine needles over hard ground.

The playing surface is provided with two main areas, one a target area 15 in which the ball 20 is located, and the other is a throwing area 16, where the players stand when throwing their rings 21 and 22, etc. To begin, the ball 20 may be placed at a set point in the target area or rolled to the general target area 15. Unlike the fixed members used in horseshoes and quoits, the ball 20 is movable. On the side of the court 10 opposite from the throwing area 16 and its throwing stations, is a confining curb 14 for helping to keep the ball 20 and the throw rings 21, 22, etc., that end in the court 10 from rolling, sliding or bouncing out of the court.

The players stand in a throwing area 16 at standard distances from the general area of the ball 20. Although the rings 21, 22, 23,, 24, 25 can be thrown from a single standard distance, it is generally preferred to mark three or four such distances by lines 17, 18, and 19 etc., for example, at nine, twelve and fifteen feet from the ball area or, for more experienced players, beginning usually at twelve feet and then at three-foot intervals, such as fifteen, eighteen, twenty-one and twenty-four feet. Each throw of any one player is made from a different distance, and successive throws are not usually made from the same distance. Usually, a middle distance is used to start the game and then other distances are used.

The ball 20 itself is preferably specially made to provide a ball 20 that is completely round, has substantial inertia on the playing surface 10, and has a somewhat resilient though rigid outer surface, preferably pebbled. The ball 20 is preferably about three inches in diameter and preferably weighs about eleven or twelve ounces. It may be made of hard synthetic elastomers, preferably a mixture of polyvinyl chloride, thermoplastic synthetic rubbers, and lubricant including zinc stearate. It may be carefully made to exhibit good balance, or it may be made off-center and the players then have to adapt to that.

The rings 21, 22 etc. are all substantially identical in size and shape. Each ring has an inner diameter of a little more than three and one-half inches for a three-inch ball and an outer diameter of about five and one-half inches. Each one is preferably symmetrical and weighs about six or seven ounces. They are preferably made from hard synthetic elastomers like those from which the ball 20 is made. The clearance around the ball 20 may average ½" for a total difference of one inch.

If two colors are used, with one color predominating in the rings, such as a predominantly blue ring or a predominantly yellow ring, there may be a series of peripheral circles in the contrasting color around the ring. There, it may be, for example, a predominantly blue ring 21 with yellow circles or a predominantly yellow ring 22 with blue circles. The ball 20 then may be provided as yellow with blue circles around one of its equators and possibly additional rings parallel thereto, or it may be blue with yellow markings.

The rings 21, 22, etc. are usually thrown with a spin, preferably a type of back spin. The attempt is usually made, except when playing in sand, not to attempt a direct ringing of the ball 20, but to achieve a saturn (FIGS. 5, 7, and 8) by having the ring 21 or 22, etc. bounce at a short distance in front of the ball 20. The rings 21, 22 etc. are never thrown overhand but are tossed somewhat like the tossing of a frisbie. A flat spinning ring 21 or 22 creates a centrifugal force that keeps the ring from rolling when it bounces off the surface 10. It should be thrown with a good spin and parallel to the ground, because otherwise accuracy is lost and scoring is less likely. Preferably, the ring 21 or 22 will be thrown at a fairly high trajectory arc to provide a good hop over and round the ball 20. If the surface 10 has a lot of bounce, it is wise to change to a lower trajectory approach in order to give better control.

In a typical game a coin, may be tossed to determine who gets the last shot, since there is an advantage in throwing last rather than first. The loser of the coin toss throws first, preferably from a mid-distance line 18, that is, a middle throwing position, and then the other player throws from the same place. Throwing may proceed alternately by going first closer, e.g., to line 17 then to the furthest line 19 and then to another mid-spot. The determination of the effective positions of the rings 21, 22, etc. after they land can be decided only at the end of the game, since one player's ring throw may nullify the position of the other player.

To start with, a saturn (FIG. 5, for example) counts six points, a leaner (e.g., in FIG. 1) three points, a touch (FIG. 6) (where the ring 21 or 22 touches the ball 20, e.g., FIG. 6, but lies wholly outside) is one point. Adjacency may be scored, with the one having the ring closest to the ball winning a point.

In addition to the saturn, there is a double saturn (FIG. 8), which, if made by the same player, counts for twice as many points, and a triple saturn, if made by the same player, counts three times six or eighteen points, so that a triple saturn will win a game. Another very important type is known as a logo (FIG. 8), which comprises a saturn with two leaners by the same player, which also wins a game.

However, if one player throws a saturn over the saturn of a previous player, he is given six points and the six points of the other saturn are not counted, since they have been nullified. Also, when the logo is made with one player having a saturn and a leaner and the other player then throws at least a leaner, the logo is nullified, and there are no points scored by either party. If a player can score three leaners, he also wins the game. A double leaner by the same person counts as six points. Where there is no saturn but there are two leaners by one player and one by another, the one with the two gets three net points.

When a game is over, each player picks up his rings, preferably by using a scoop 30. The scoop 30 comprises two members. A handle portion 31 has a portion 32 for grasping by one's hand, a stop or ball 33 to restrict movement of the rings therebeyond, and a shank 34 with a threaded end 35. The other member is a scoop pickup portion 36 having a shank 37 that mates with the shank 34 and threads around the end 35, a curved portion 38 that makes a 45° arc from the shank 37, and a straight end portion 39 with a blade-like pickup portion **39*a***.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A game of skill, comprising:

a playing court having a hard base covered with a yieldable covering, a spherical ball located on said court and able to roll thereon, a plurality of identically shaped rings with a round cross section having an inner across-the-ring diameter somewhat larger than the diameter of said ball to provide a loose clearance when a ring encircles said ball, and a plurality of throwing stations at spaced distances from said court from each of which at least one ring is thrown by each participant.

2. The game of claim 1 wherein said throwing stations are located on one side of said court, the opposite side of said court having a confining curb for helping to keep said ball and the thrown rings that land in said court from rolling, sliding, or bouncing out of said court.

3. The game of claim 1 wherein said court comprises a wooden base covered with a padding.

4. The game of claim 1 wherein said court comprises a short-cut lawn area.

5. The game of claim 1 wherein said court is a deposit of sand.

6. A game of skill, comprising:

a generally level playing surface having a firm base with a yieldable covering, a spherical ball, of hard synthetic elastomer a plurality of identically shaped circular, toroidal rings of hard synthetic elastomer with a circular cross section, the torus having an inner diameter somewhat larger than the diameter of said ball to provide a loose clearance when a ring encircles said ball, and a ball area on said playing surface, where the ball is located during playing, providing an area within which the ball may roll if struck by a thrown ring and where the rings can land and possibly bounce or slide, a plurality of throwing stations on said playing surface, from each of which at least one ring is thrown by each participant.

7. The game of claim 6 including a pair of scoop means for picking up a plurality of rings one at a time and holding them conveniently available.

8. The game of claim 7 wherein said scoop means comprises a shank portion having a handle portion at one end with a flange spaced therefrom for retaining at least one said ring and a curved portion leading to another end which is flattened to assist in picking up a ring.

9. A game of skill, comprising:

a generally level playing court having a hard base covered with a carpet-like padding, a hard spherical ball of synthetic elastomer located on said court and able to roll thereon, a plurality of identically shaped hard circular toroidal rings of synthetic elastomer with a circular cross section having an inner across-the-ring diameter somewhat larger than the diameter of said ball to provide a loose clearance when a ring encircles said ball, and a plurality of throwing stations at spaced distances from said court on one side of said court, from each of which at least one ring is thrown by each participant, the opposite side of said court having a confining curb for helping to keep said ball and the thrown rings that land in said court from rolling, sliding, or bouncing out of said court.

10. The game of claim 9 including a pair of scoop means for picking up a plurality of rings one at a time and holding them conveniently available, said scoop means comprising a shank portion having a handle portion at one end with a flange spaced therefrom for retaining at least one said ring and a curved portion leading to another end which is flattened to assist in picking up a ring.

11. A game set comprising a spherical ball about three inches in diameter, a plurality of identically shaped rings, each with a round cross section having an inner across-th-ring diameter somewhat larger than the diameter of said ball to provide a loose clearance of about ½ to 1 inch when a ring encircles said ball, and a pair of scoops for picking up said rings from a generally flat surface on which said rings rest, each comprising a shank portion with a flange therearound spaced from a first end and a curved portion leading to a flattened pick-up second end providing means for picking us said rings.

12. The game set of claim 11 wherein each scoop is comprised of two pieces, one defining the shank portion and one the curved portion.

13. A method of playing a game, comprising, providing a generally flat playing surface having a firm base and a yieldable covering, providing a spherical ball, placing the ball on a court area of said surface, providing a plurality of throwing stations on said surface, providing a plurality of identically shaped rings with a round cross section having an inner across-the-ring diameter somewhat larger than the diameter of said ball to provide a loose clearance when a ring encircles said ball, throwing each ring toward the ball, the throwing being done from each of several standard throwing distances, by each of at least two participants who alternate in throwing the rings, attempting at each throw (1) to encircle the ball with at least one ring, either by (a) direct landing or by (b) bouncing a ring over and around it, or by (c) causing the ball to roll over and into a previously thrown ring, (2) to cause the thrown ring to rest directly against the ball or to lean on it, (3) to cause the thrown ring to touch said ball, (4) to cause the ball to move to a new position, or (5) to cause an already thrown ring to move to a new position.

* * * * *